United States Patent [19]

Kerschner

[11] 3,960,462

[45] June 1, 1976

[54] SEALING MEMBER

[75] Inventor: James J. Kerschner, Tonawanda, N.Y.

[73] Assignee: Acme Highway Products Corporation, Buffalo, N.Y.

[22] Filed: July 21, 1975

[21] Appl. No.: 597,458

[52] U.S. Cl. ..... 404/64; 277/205; 277/207 R

[51] Int. Cl.[2] ..... E04C 11/10

[58] Field of Search ..... 404/64, 65; 277/205, 277/207, 237 R

[56] References Cited

UNITED STATES PATENTS

| | | | |
|---|---|---|---|
| 3,595,141 | 7/1971 | Boney | 404/65 |
| 3,608,442 | 9/1971 | Berchou et al. | 404/65 |
| 3,645,176 | 2/1972 | Berchou et al. | 404/64 |
| 3,732,788 | 5/1973 | Brown | 404/64 |
| 3,762,826 | 10/1973 | Bowman | 404/64 |
| 3,881,834 | 5/1975 | Bowman | 404/64 |

*Primary Examiner*—Robert I. Smith
*Attorney, Agent, or Firm*—Christel & Bean

[57] ABSTRACT

A resilient sealing member for use in an expansion joint comprising a tubular body having an internal truss structure which includes a pair of intersecting crossbars extending between the sidewalls and bottom wall of the tubular body. The sealing member, being of the low pressure type, further includes a vertically disposed compression bar extending between the mid-portion of the top wall of the member and the intersection of the crossbars to exert a downward pressure on the crossbars during compression of the member to thus reduce some of the sidewall pressures in a manner resulting in a substantially level pressure profile across the vertical dimension of the sidewalls.

11 Claims, 4 Drawing Figures

Fig. 1.
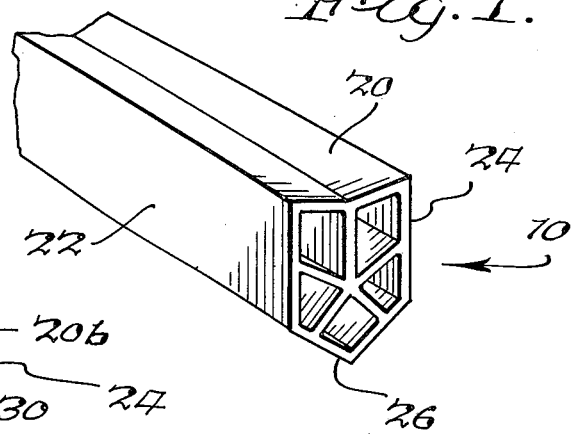
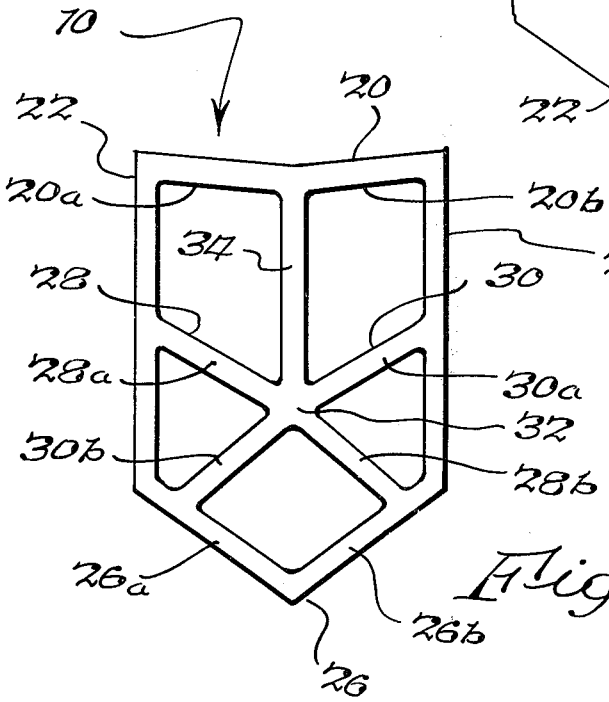
Fig. 2.
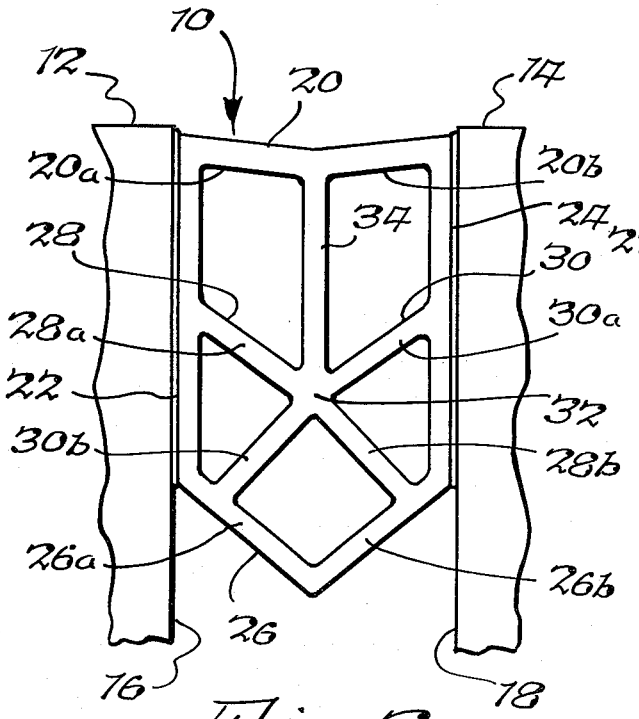
Fig. 3.
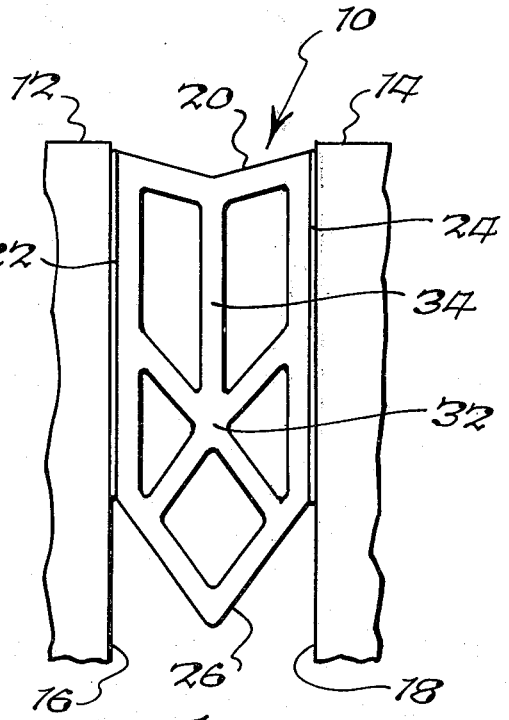
Fig. 4.

SEALING MEMBER

BACKGROUND OF THE INVENTION

This invention relates to sealing members, and more particularly, sealing members employed in expansion joints which are disposed in grooves formed in adjacent pavement blocks or other structural elements.

In the construction of highways, bridges, architectural concourses, airport runways and the like in which pavement sections or slabs of concrete or other paving materials are used, provision must be made for the expansion and contraction of such sections due to variations of temperature. Conventionally, grooves are provided between adjacent pavement sections to accommodate the expansion and contraction thereof, such grooves being sealed to preclude the entry of liquids and solid materials therein and to prevent such foreign matter from passing through the grooves and beneath the pavements. These grooves are often sealed by means of hollow, resilient, elastic strips or seals which can be compressed and expanded in accordance with the expansion and contraction of the pavement material.

Often, these seals are provided with internal supporting truss structures comprising a plurality of ribs and crossbars defining numerous spaces or openings therebetween to accommodate folding of the ribs and bars during compression and such seals are enjoying increased acceptance for many purposes. However, the desirability of maintaining the pressure profile across the vertical height of the seal sidewalls substantially level or equal at all points therealong has been recognized. Such desirability is particularly apparent in a low pressure type of seal which is designed to exert a minimum pressure on the joint sides while still maintaining an effective seal.

SUMMARY OF THE INVENTION

It is an object of the present invention to provide an improved low pressure sealing member having an internal truss structure providing relatively low sealing pressure while maintaining a substantially level pressure profile across the vertical surfaces of the sidewalls of the sealing member.

It is another object of this invention to provide the foregoing sealing member with a vertically disposed compression bar for transferring some of the sidewall pressure created by compression of the sealing member downward away from the sidewalls.

It is still another object of the present invention to provide an improved sealing member having spaced, outer, exposed portions which move uniformly toward and away from each other during compression and expansion of the aforesaid sealing member.

The sealing member of the present invention is characterized by the provision of an internal truss structure incorporating a pair of segmented crossbars extending diagonally from the midportions of the sidewalls to the opposite end portions of the bottom wall of the sealing member. A vertically disposed compression bar is in turn disposed between the midportion of the top wall of the member and the intersection of the crossbars. Upon compression of the member, the downward movement of the compression bar acts to equalize pressure along the sidewalls while transferring some of the sidewall pressure downward and away therefrom so that the sealing member operates as a total unit to seal out water and other types of debris enumerated hereinabove.

The foregoing and other objects, advantages and characterizing features of this invention will become clearly apparent from the ensuing detailed description of an illustrative embodiment thereof, taken together with the accompanying drawings wherein like reference numerals denote like parts throughout the various views.

BRIEF DESCRIPTION OF THE DRAWING FIGURES

FIG. 1 is a perspective view of one end of a sealing member constructed in accordance with this invention and shown in its uncompressed state, being broken away to indicate indeterminate length;

FIG. 2 is an end elevational view of the sealing member of FIG. 1, shown in its natural, uncompressed condition;

FIG. 3 is an end elevational view of the sealing member of FIG. 2 shown in a slightly compressed condition between adjacent pavement sections which are broken away for convenience and illustration; and FIG. 4 is a view similar to FIG. 3 showing the sealing member of FIG. 2 in a greatly compressed condition.

DETAILED DESCRIPTION OF ILLUSTRATIVE EMBODIMENT

Referring now in detail to the illustrative embodiment depicted in the drawings, there is shown an elongated, resiliently, yieldable sealing member generally designated 10 constructed in accordance with this invention. FIG. 2 illustrates sealing member 10 in its natural, uncompressed condition. FIGS. 3 and 4 illustrate sealing member 10 in various degrees of compression between a pair of spaced structural members 12 and 14 having opposed surfaces 16 and 18 defining a groove therebetween. Structural members 12 and 14 can be pavement slabs or metal angle members partially embedded in concrete or other construction material to accommodate a single sealing member 10. Members 12 and 14 also can represent laterally spaced beams extending longitudinally in the expansion groove between adjacent slabs for separating and supporting a series of laterally spaced sealing members 10 in a composite compression sealing system. The insertion of sealing member 10 into the groove defined by members 12 and 14 is facilitated by the application to faces 16 and 18 of a thin layer of a suitable, lubricant-adhesive which when set cements sealing member 10 in place.

Sealing member 10, preferably is composed of an elastomeric material, such as neoprene for example or any other suitable resiliently yieldable material having similar properties of durability and high abrasion resistance, adequate compression and expansion capabilities and being capable of withstanding temperature extremes, sunlight, weathering, oxidation and deleterious chemicals. Sealing member 10 is extruded as a unitary, one-piece construction and can be of any length appropriate to conform to the length of the groove in which it is to be used. Also, it should be understood that the sealing member of this invention though being of the generally known low pressure type, has general utility in various expansion joint applications including, without limitation, highways, sidewalks, airfield runways, architectural concourses, and the like.

Sealing member 10 includes a top wall 20 and sidewalls 22 and 24 which are substantially parallel and straight between the longitudinal end portions thereof and from the top and bottom edges thereof. The upper edges of sidewalls 22 and 24 are connected to downwardly sloping portions 20*a* and 20*b* of the top wall which converge to form a V-shaped recess which facilitates downward movement of top wall 20 when the sides 22 and 24 of sealing member 10 are pressed toward each other, thereby avoiding the extension of any portion of sealing member 10 above the surface of the adjacent members 12 and 14. As used herein, the terms upper, lower, top, bottom, vertical, horizontal are applied only for convenience of description with reference to the drawing and should not be taken as limiting the scope of this invention.

The lower edges of sidewalls 22 and 24 are connected to a bottom wall 26 having downwardly sloping portions 26*a* and 26*b* which converge to form a V-shaped bottom wall. Top and bottom walls 20 and 26 are formed integral with sidewalls 22 and 24 to form corners therewith and to define a tubular body.

Sealing member 10 is provided with an internal truss structure comprising a pair of crossbars 28 and 30 which extend diagonally from the midportions of sidewalls 22 and 24 to the opposite end portions of bottom wall 26. The crossbars 28 and 30 each include respective first portions 28*a* and 30*a* and respective second portions 28*b* and 30*b*. All of the aforesaid portions of the crossbars intersect and are interconnected at 32. The aforesaid first and second portions are indicated as such in view of the fact that the first portions of the crossbars 28*a* and 30*a* are disposed slightly more towards the horizontal than the second portions 28*b* and 30*b*. In addition, to the aforesaid crossbars, the internal truss structure further includes a vertically disposed compression bar 34 which extends between the midportion of top wall 20 at the juncture of portions 20*a* and 20*b* to the intersection of the crossbars at point 32.

A significant feature of this invention resides in the provision of internal support truss members which are preformed to facilitate folding and to insure folding thereof in a predetermined direction, to thereby control the pressure generation experienced along the sidewalls 22 and 24 when mounted between structural members 12 and 14. The equal or level pressure distribution profile between the upper and lower edges of the seal sidewalls is considered a distinct advantage since the sidewall will not tend to distort and will tend to more effectively maintain a uniform sealing engagement with the members 12 and 14.

Accordingly, the top wall portions 20*a* and 20*b* are formed at an angle of slightly less than 180° with respect to one another so that such portions tend to fold downwardly during compression of the seal. The movement of portions 20*a* and 20*b* tends to urge the compression bar 34 downwardly which in turn exerts a downward pressure on crossbar portions 28*a* and 30*a* thus transferring some of the sidewall pressure in the midportions thereof downward away from the sidewalls. As the point of intersection 32 is urged downwardly, the second crossbar portions 28*b* and 30*b* transfer some pressure to the bottom wall portions 26*b* and 26*a* respectively. However, due to the adjacency of the intersection of the portions 28*b* and 30*b* with the bottom wall to the sidewalls of the member, a portion of the force transmitted along portions 28*b* and 30*b* is transmitted to the lower edge portions of the sidewalls as well as to the bottom wall 26. However, the deeper angle between the portions of the bottom wall results in less compressive reaction forces due to the bottom wall as compared to the relatively greater pressure reaction forces induced by the top wall of the member during compression of the seal.

All of the above factors result in a substantially level pressure profile between the upper and lower edges of the seal sidewalls.

In summary, the compression bar 34 urges the point of intersection 32 downwardly during compression of the seal and portions 28*a* and 30*a* of the truss structure tend to pull the midportions of the respectively associated sidewalls inwardly to lower the sidewall pressure in such midportions. In addition, the bottom wall 26 tends to resist compression less readily than the top wall due to the deeper angle between its portions 26*a* and 26*b* so as to develop relatively less reaction pressure than does the top wall 20. However, some of the pressure force transmitted to the crossbar portions 28*b* and 30*b* from the midportions of the sidewall are transmitted to the lower edge portions of the sidewalls which results in the overall, substantially level pressure distribution between the upper and lower edges of the sidewalls.

From the foregoing it is apparent that the objects of the present invention have been fully accomplished. As a result of this invention, an improved sealing member is provided having a simple internal truss structure which provides for controlled folding of the seal during compression. In addition, the internal truss structure operates to effectively reduce some of the sidewall pressure experienced by the seal and to redistribute a portion thereof so that substantially equal pressure is developed across the surfaces of the seal sidewalls.

A preferred embodiment of this invention having been described and illustrated, it is to be understood that this has been done by way of illustration only.

I claim:

1. A sealing member comprising: a resiliently yieldable tubular body having a top wall, a bottom wall and opposite sidewalls, an internal truss structure including a pair of crossbars extending downwardly at an angle from said sidewalls at points spaced below the upper ends thereof to said bottom wall at points spaced from the opposite ends thereof, said crossbars intersecting intermediate their opposite ends, and a generally vertically disposed compression bar extending from the midportion of said top wall to a termination with the intersection of said crossbars for reducing and equalizing the pressure along said sidewalls during compression of said member.

2. A sealing member as set forth in claim 1 comprising an integral, one-piece construction throughout.

3. A sealing member according to claim 1 wherein said top wall has downwardly sloping portions forming a V-shaped recess and adapted to fold into the upper space defined by said intersecting crossbars when said sidewalls are pressed toward each other to thereby urge said compression bar downwardly.

4. A sealing member according to claim 3 wherein said top wall includes a pair of angularly related portions extending inwardly and slightly downwardly from said sidewalls and joined together at a common juncture at an angle slightly less than 180°.

5. A sealing member according to claim 3 wherein said bottom wall has downwardly sloping portions forming a V-shaped recess and adapted to fold downwardly when said sidewalls are pressed toward each other.

6. A sealing member as set forth in claim 5 wherein said portions of said bottom wall slope downwardly at an angle greater than the corresponding said portions of said top wall.

7. A sealing member as set forth in claim 3 wherein each of said crossbars includes a first and second portion, each said first portion extending downwardly from its respective sidewall to intersect with the lower end of said compression bar and each said second portion extending downwardly from an intersection with the lower end of said compression bar at a downward angle greater than said first portion to intersect with said bottom wall.

8. A sealing member as set forth in claim 7 wherein each said first portion of said crossbars extends downwardly from the midportion of its respective sidewall.

9. A sealing member as set forth in claim 8 wherein said bottom wall has downwardly sloping portions forming a V-shaped recess and adapted to fold downwardly when said sidewalls are pressed toward each other.

10. A sealing member as set forth in claim 9 wherein said portions of said bottom wall slope downwardly at an angle greater than the corresponding said portions of said top wall.

11. A sealing member as set forth in claim 10 wherein each said second portion of said crossbars intersects said bottom wall portions at locations adjacent to the intersection of said sidewalls therewith, but being spaced from said intersection of said sidewalls and said bottom wall.

* * * * *